US011930910B2

(12) United States Patent
Chung et al.

(10) Patent No.: US 11,930,910 B2
(45) Date of Patent: Mar. 19, 2024

(54) STICK TYPE COSMETIC CONTAINER

(71) Applicant: CTK COSMETICS CO., LTD., Seoul (KR)

(72) Inventors: In Yong Chung, Seoul (KR); Won Eui Lee, Seoul (KR); In Young Um, Seoul (KR); Kyung Ho Kang, Suwon-si (KR)

(73) Assignee: CTK COSMETICS CO., LTD., Seoul (KR)

( * ) Notice: Subject to any disclaimer, the term of this patent is extended or adjusted under 35 U.S.C. 154(b) by 0 days.

(21) Appl. No.: 18/038,094

(22) PCT Filed: Apr. 7, 2021

(86) PCT No.: PCT/KR2021/004332
§ 371 (c)(1),
(2) Date: May 22, 2023

(87) PCT Pub. No.: WO2022/108009
PCT Pub. Date: May 27, 2022

(65) Prior Publication Data

US 2023/0397708 A1 Dec. 14, 2023

(30) Foreign Application Priority Data

Nov. 20, 2020 (KR) ..... 10-2020-0156682

(51) Int. Cl.
*A45D 40/06* (2006.01)

(52) U.S. Cl.
CPC ..... *A45D 40/065* (2013.01); *A45D 40/06* (2013.01)

(58) Field of Classification Search
CPC ..... A45D 40/06; A45D 40/065
See application file for complete search history.

(56) References Cited

U.S. PATENT DOCUMENTS

| | | | | |
|---|---|---|---|---|
| 8,915,664 | B2 * | 12/2014 | Lu | A45D 40/06 401/78 |
| 11,076,679 | B1 * | 8/2021 | Chung | A45D 40/04 |
| 11,622,613 | B1 * | 4/2023 | Chung | A45D 40/06 401/75 |
| 2019/0269221 | A1 | 9/2019 | Jung et al. | |

FOREIGN PATENT DOCUMENTS

| | | | |
|---|---|---|---|
| KR | 20-0161033 | Y1 | 12/1999 |
| KR | 20-0478730 | Y1 | 11/2015 |
| KR | 10-2020-0089076 | A | 7/2020 |
| KR | 10-2152127 | B1 | 9/2020 |
| KR | 20210131773 | A * | 11/2021 |

* cited by examiner

*Primary Examiner* — Jennifer C Chiang
(74) *Attorney, Agent, or Firm* — Bridgeway IP Law Group, PLLC; Jihun Kim

(57) ABSTRACT

Proposed is a stick type cosmetic container that includes a first holder for supporting the underside of a cosmetic material to allow the cosmetic material to move in upward and downward directions, a handle for controlling the upward and downward movements of the cosmetic material and having a first hollow portion formed at the inside thereof, an inner container located at the first hollow portion and thus rotatable with respect to the handle and having fixing and fastening grooves formed on the lower end periphery thereof and thus fixedly fastened to the handle whenever the inner container rotates once, and a second holder located inside the inner container to support the underside of the first holder.

6 Claims, 7 Drawing Sheets

STICK TYPE COSMETIC CONTAINER

TECHNICAL FIELD

The present invention relates to a stick type cosmetic container, more specifically to a stick type cosmetic container that is capable of allowing a cosmetic material stored in a cosmetic product such as a lipstick, a lip gloss, a sun stick, foundation, and the like to be used up, without remnant left therein, and being separately thrown away after the completion of the use.

BACKGROUND ART

Recently, a great interest in the cosmetic industry has been shown. This is because distribution networks such as online channels are diversified and the Korean wave causes sales performance of South Korea cosmetic brands to greatly increase in China, Southeast Asia, and the like. Such growth of the cosmetic industry in South Korea is called K-Beauty, which comes in the time light as one of main streams in the market.

Cosmetic technologies, which include cosmetic compositions or formulas for natural materials or functional materials, cosmetic containers with improvements in functionality and usability, and methods for manufacturing such cosmetic containers, have been continuously studied and developed.

The cosmetic containers are containers in which cosmetic materials or cosmetic tools such as puffs are accommodated, and they have as various shapes and structures as cosmetic products have.

There is a stick type cosmetic container as one of the cosmetic containers. The stick type cosmetic container stores a solid or semi-solid cosmetic material of a cosmetic product such as a lipstick, a lip gloss, a sun stick, and the like in an inner container and protects the cosmetic material stored in the inner container from the outside through an outer container.

However, the stick type cosmetic container is thrown away in a state where a relatively large amount of cosmetic material stored therein is not used up. Further, if it is desired that the stick type cosmetic container is thrown away after the cosmetic material has been removed, the cosmetic material left therein is dug out through a cotton swab or removed after frozen, which is very inconvenient.

To overcome such problems, some technologies have been suggested, but they still have structural difficulties in completely consuming the cosmetic material left. Further, a stick type cosmetic container, which allows a cosmetic material stored therein to be used up, without any cosmetic material left, and is simple and convenient in configuration to improve productivity and usability thereof, has been not developed yet.

DISCLOSURE

Technical Problem

Accordingly, an object of the present invention is to provide a stick type cosmetic container that is capable of allowing a cosmetic material stored in a cosmetic product such as a lipstick, a lip gloss, a sun stick, foundation, and the like to be used up, without remnant left therein, and being separately thrown away after the completion of the use.

The technical problems to be achieved through the present invention are not limited as mentioned above, and other technical problems not mentioned herein will be obviously understood by one of ordinary skill in the art through the following description.

Technical Solution

To accomplish the above-mentioned objects, a stick type cosmetic container according to the present invention may include: a first holder for supporting the underside of a cosmetic material to allow the cosmetic material to move in upward and downward directions; a handle for controlling the upward and downward movements of the cosmetic material and having a first hollow portion formed at the inside thereof; an inner container located at the first hollow portion and thus rotatable with respect to the handle and having fixing and fastening grooves formed on the lower end periphery thereof and thus fixedly fastened to the handle whenever the inner container rotates once; and a second holder located inside the inner container to support the underside of the first holder.

According to the embodiment of the present invention, the handle may include a rotation control member having fixing and fastening protrusions locally inserted into the fastening grooves of the inner container, a lower frame located under the rotation control member and thus provided as the underside of the stick type cosmetic container, and a handle frame for covering the rotation control member and the side periphery of the lower frame.

According to the embodiment of the present invention, the fastening grooves may include a first fastening groove and a second fastening groove and the fixing and fastening protrusions may include a first fixing and fastening protrusion and a second fixing and fastening protrusion, so that when the inner container rotates with respect to the rotation control member, the first fixing and fastening groove escapes from the first fixing and fastening protrusion, rotates once, and is thus coupled to the second fixing and fastening protrusion to allow the handle and the inner container to be fixedly fastened to each other again.

According to the embodiment of the present invention, the handle frame may include guide members disposed on top thereof and coming into contact with the underside of the inner container to guide the inner container so that the inner container is located back to a reference position after once rotation in the process of a secondary upward movement; and sensitivity control members disposed on one side of the guide members to relieve the sensitivity generated upon the rotating movement in the process of the secondary upward movement.

According to the embodiment of the present invention, the fixing and fastening grooves and the fixing and fastening protrusions may serve to allow the inner container to be located at the reference position in the process of a primary upward movement, and the guide members may serve to allow the inner container to be located at the reference position in the process of the secondary upward movement.

According to the embodiment of the present invention, the inner container may include a first stopper member for stopping the upward movement of the second holder to move the cosmetic material up to a first designated position during the primary upward movement, and the second holder may include a locking portion and a first stopper groove locked onto the first stopper member.

According to the embodiment of the present invention, the first holder may include a fastening release inducer for inducing the fastening release of the locking portion to allow the second holder to secondarily move the cosmetic material upward after the primary upward movement and a second stopper member locked onto the locking portion released from the fastening to allow the secondary upward movement of the second holder to be stopped at a second designated position.

According to the embodiment of the present invention, the second holder may include a sensitivity relieving member formed on one surface thereof to relieve the sensitivity generated from the upward or downward movement thereof with respect to the inner container.

According to the embodiment of the present invention, the stick type cosmetic container may further include an outer container for surroundingly covering the inner container.

Advantageous Effectiveness

According to the present invention, the stick type cosmetic container can allow the cosmetic material stored in a cosmetic product such as a lipstick, a lip gloss, a sun stick, foundation, and the like to be used up, without remnant left therein, and being separately thrown away after the completion of the use.

The effectiveness of the invention is not limited as mentioned above, and it should be understood to those skilled in the art that the effectiveness of the invention may include another effectiveness as not mentioned above from the detailed description of the present invention.

MODE FOR INVENTION

Figure 1:
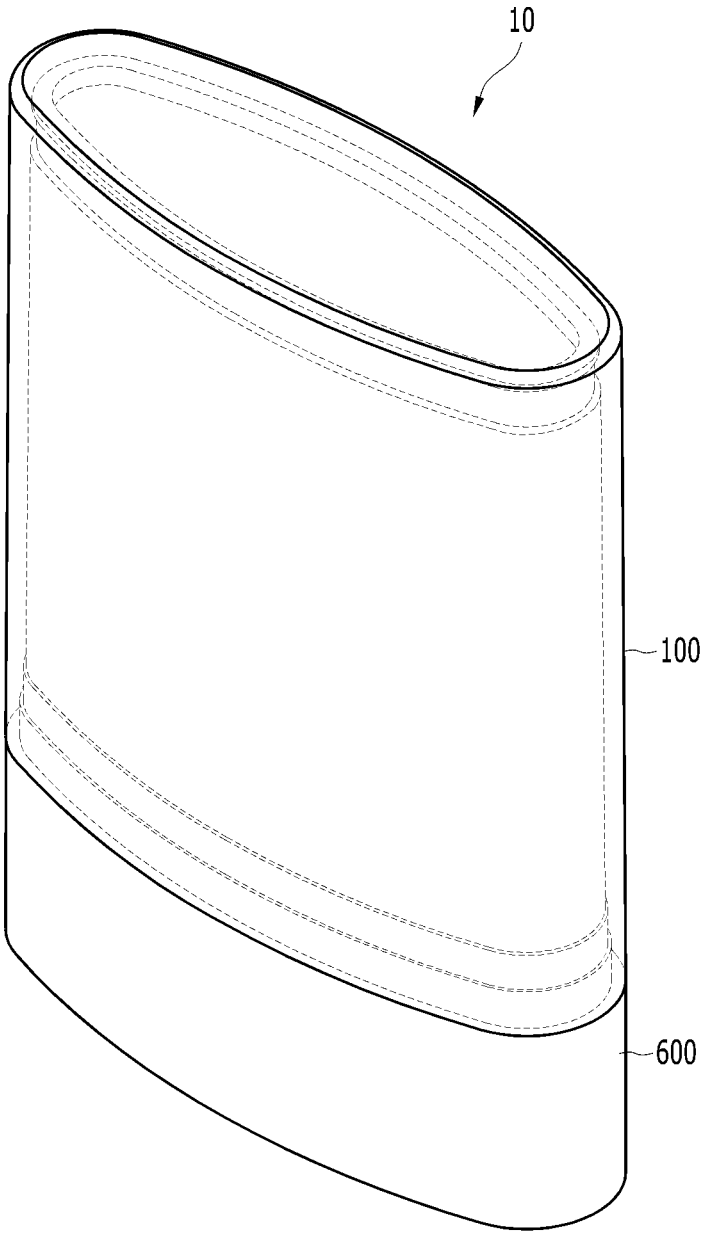
FIG. 1 is a perspective view showing a stick type cosmetic container according to the present invention.

Hereinafter, the present invention will be explained in detail with reference to the attached drawings. Before the present invention is disclosed and described, it is to be understood that the disclosed embodiments are merely exemplary of the invention, which can be embodied in various forms. The corresponding parts in the embodiments of the present invention are indicated by corresponding reference numerals and the repeated explanation on the corresponding parts will be avoided.

The term 'connected (contacted or coupled)', as used herein, is defined as connected, although not necessarily directly, and not necessarily mechanically. To the contrarily, the term 'directly connected', as used herein, is defined as connected without having any component disposed therebetween. In the description, when it is said that one portion is described as "includes" any component, one element further may include other components unless no specific description is suggested.

Terms used in this application are used to only describe specific exemplary embodiments and are not intended to restrict the present invention. An expression referencing a singular value additionally refers to a corresponding expression of the plural number, unless explicitly limited otherwise by the context. In this application, terms, such as "comprise", "include", or 'have", are intended to designate those characteristics, numbers, steps, operations, elements, or parts which are described in the specification, or any combination of them that exist, and it should be understood that they do not preclude the possibility of the existence or possible addition of one or more additional characteristics, numbers, steps, operations, elements, or parts, or combinations thereof.

Now, an explanation of an embodiment of the present invention will be given in detail with reference to the attached drawings.

Figure 2:
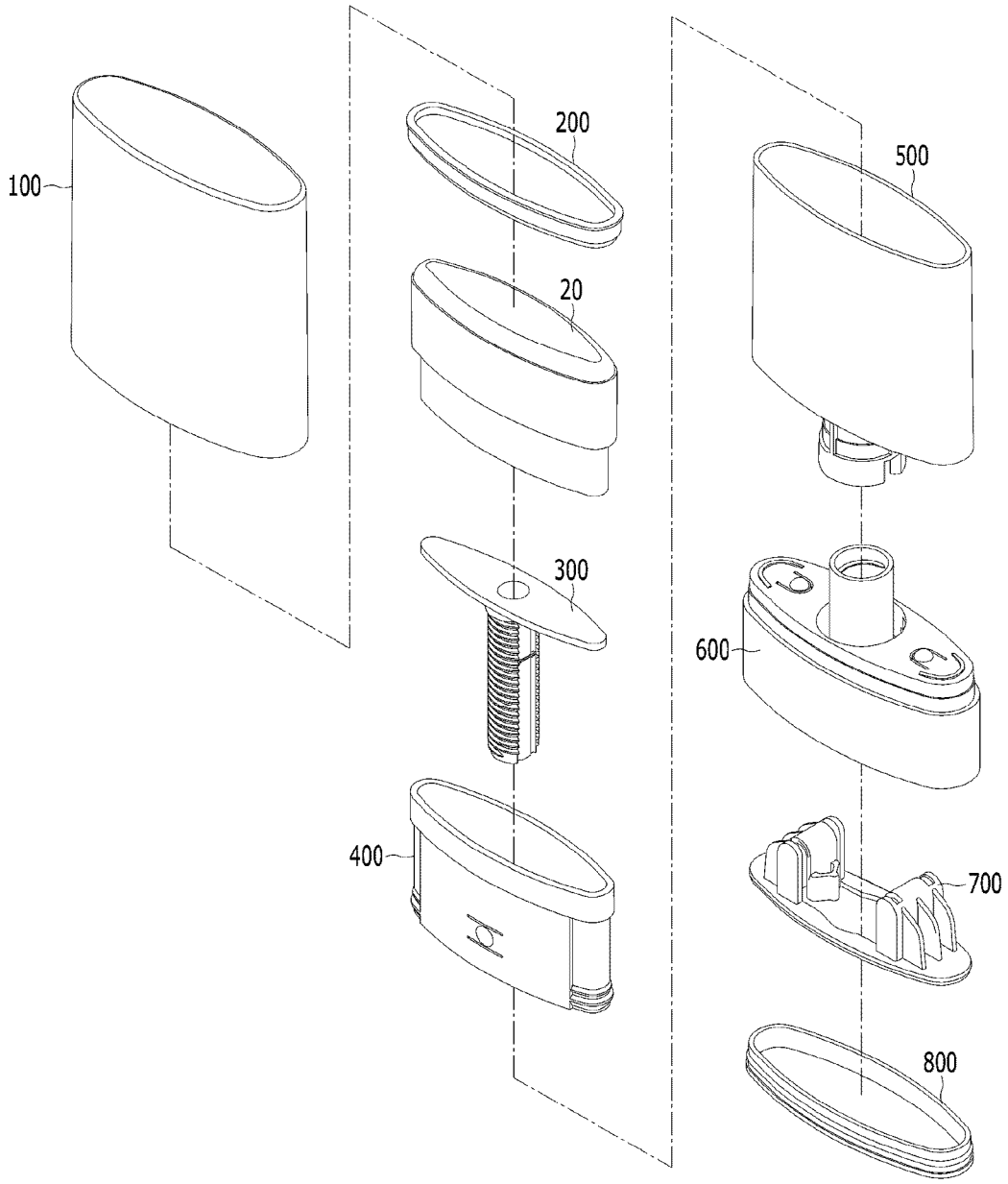
FIG. 2 is an exploded perspective view showing the stick type cosmetic container according to the present invention.

FIG. 1 is a perspective view showing a stick type cosmetic container according to the present invention, and FIG. 2 is an exploded perspective view showing the stick type cosmetic container according to the present invention.

A stick type cosmetic container 10 according to the present invention is used for a container of a cosmetic product such as a sun stick, foundation, a lipstick, a lip gloss, and the like.

Referring to FIG. 2, the stick type cosmetic container 10 according to an embodiment of the present invention includes an outer container 100, a cosmetic material cover 200, a cosmetic material 20, a first holder 300, a second holder 400, an inner container 500, a handle frame 600, a rotation control member 700, and a lower frame 800.

The stick type cosmetic container 10 according to another embodiment of the present invention includes all of the outer container 100, the cosmetic material cover 200, the first holder 300, the second holder 400, the inner container 500, the handle frame 600, the rotation control member 700, and the lower frame 800 except for the cosmetic material 20.

In this case, the handle frame 600, the rotation control member 700, and the lower frame 800 are lower components constituting a handle.

When the stick type cosmetic container 10 according to the present invention is viewed from the outside, as shown in FIG. 1, the outer container 100 and the handle frame 600 disposed on the underside of the outer container 100 are exposed to the outside to thus provide the outer shape of the stick type cosmetic container 10.

Figure 3:
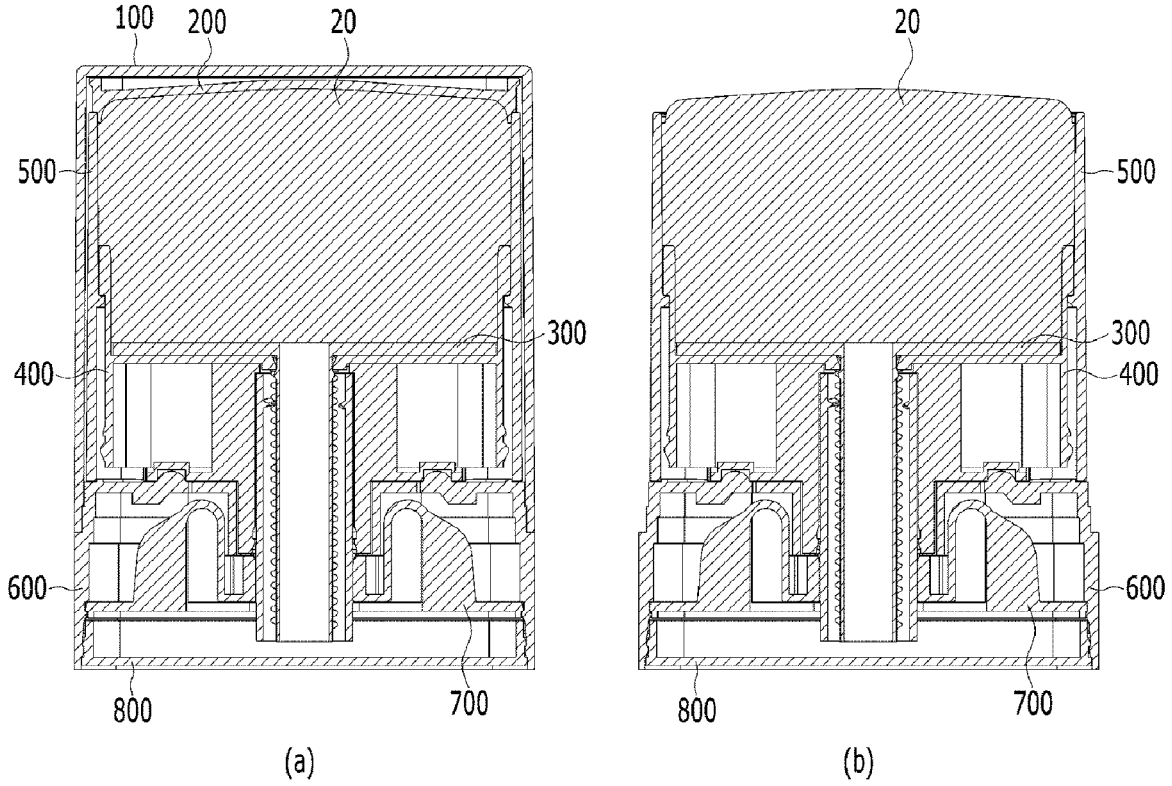
FIG. 3 is a sectional view showing the stick type cosmetic container according to the present invention.

FIG. 3 is a sectional view showing the stick type cosmetic container according to the present invention. In specific, FIG. 3*a* is a sectional view showing the stick type cosmetic container 10 in which the outer container 100 and the cosmetic material cover 200 are coupled to each other, and FIG. 3*b* is a sectional view showing the stick type cosmetic container 10 in which the outer container 100 and the cosmetic material cover 200 are removed therefrom.

Next, an explanation of the configuration of the stick type cosmetic container 10 according to the present invention will be given in detail with reference to FIGS. 2 and 3.

According to the present invention, the outer container 100 is fastened to the lower frame 600 to thus surround the inner container 500, thereby providing an outer frame of the stick type cosmetic container 10.

The cosmetic material cover 200 is located between the cosmetic material 20 and the outer container 100 and serves to completely cover top of the cosmetic material 20 disposed at the inside of the inner container 500.

The first holder 300 serves to support the underside of the cosmetic material 20 to allow the cosmetic material 20 disposed at the inside of the inner container 500 to move in upward and downward directions.

The second holder 400 is located at the inside of the inner container 500 and supports the lower periphery of the first holder 300.

The inner container 500 includes one side portion in which a first hollow portion is formed to allow a given portion of the handle (the handle frame 600, the rotation control member 700, and the lower frame 800) to be located therein and the other portion formed among the cosmetic material 20, the second holder 400, and the outer container 100. The inner container 500 rotates with respect to the handle (the handle frame 600, the rotation control member 700, and the lower frame 800) whose given portion is located in the first hollow portion thereof and thus moves the cosmetic material 20 disposed in the upper portion thereof in the upward and downward directions. Further, the inner container 500 has fixing and fastening grooves 530 formed on the lower end periphery thereof so that the inner container 500 is fixedly fastened to the handle (the handle frame 600, the rotation control member 700, and the lower frame 800), whenever it rotates once.

The handle controls the upward and downward movements of the cosmetic material 20 and has the first hollow portion formed at the inside thereof.

The handle frame 600 surroundingly covers the rotation control member 700 and the side periphery of the lower frame 800.

The rotation control member 700 includes fixing and fastening protrusions 710 formed around the lower end periphery of the given portion of the inner container 500 located at the first hollow portion and thus locally inserted into the fixing and fastening grooves 530 of the inner container 500, so that the rotation control member 700 is fastened to the inner container 500.

The lower frame 800 is located under the rotation control member 700 and thus provided as the underside of the stick type cosmetic container 10.

Figure 4:
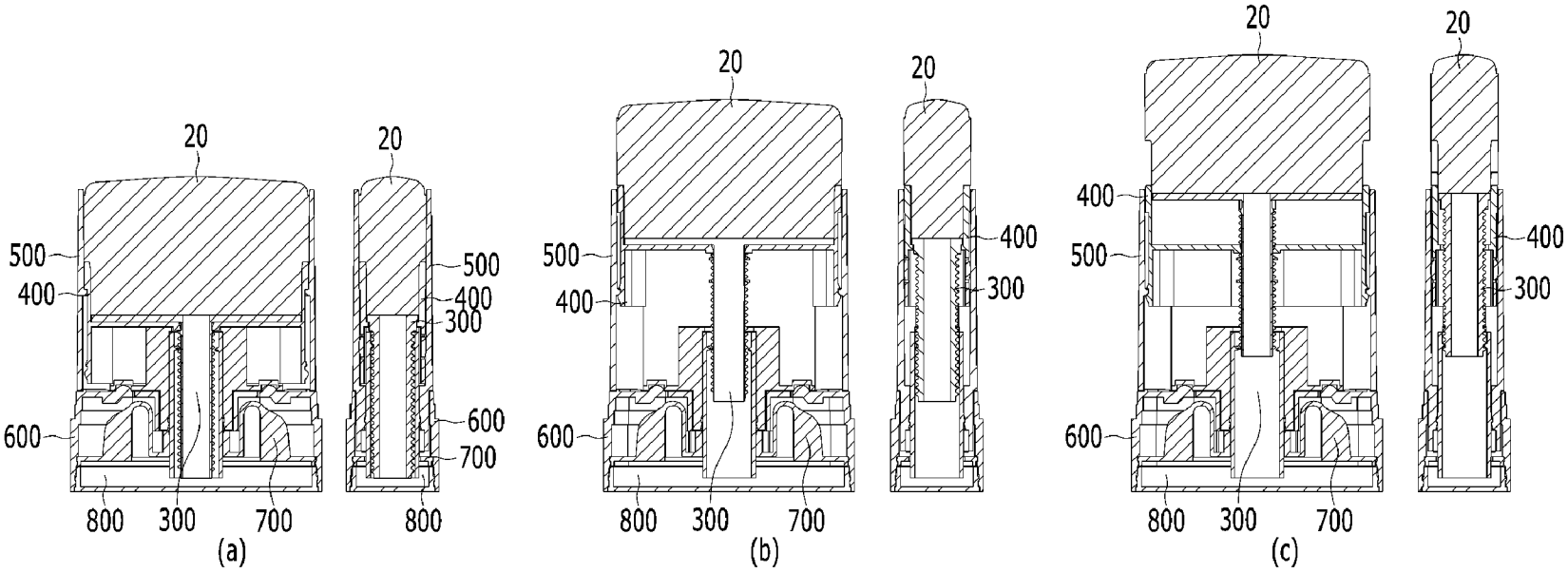
FIG. 4 is a sectional view showing a state where an inner container and first and second holders rotate with respect to a handle to cause a cosmetic material to gradually move upward in the stick type cosmetic container according to the present invention.

FIG. 4 is a sectional view showing a state where the inner container and the first and second holders rotate with respect to the handle to cause the cosmetic material to gradually move upward in the stick type cosmetic container according to the present invention. In specific, FIG. 4*a* is a sectional view showing an initial state of the stick type cosmetic container 10, FIG. 4*b* is a sectional view showing a state in which as the stick type cosmetic container 10 rotates, a primary upward movement through which the cosmetic material 20 moves upward to a first designated position is completed, and FIG. 4*c* is a sectional view showing a state in which as the stick type cosmetic container 10 keeps rotating after the primary upward movement of the stick type cosmetic container 10 has been completed, a secondary upward movement through which the cosmetic material 20 moves upward to a second designated position is completed.

Referring to FIG. 4, the stick type cosmetic container 10 according to the present invention is configured to allow the inner container 500, the first holder 300, and the second holder 400 to rotate with respect to the handle (the handle frame 600, the rotation control member 700, and the lower frame 800) in the primary upward movement changed from the state of FIG. 4*a* to the state of FIG. 4*b*, so that the first holder 300, the second holder 400, and the cosmetic material 20 move upward.

Further, the stick type cosmetic container 10 according to the present invention is configured to allow the inner container 500, the first holder 300, and the second holder 400 to rotate with respect to the handle (the handle frame 600, the rotation control member 700, and the lower frame 800) in the secondary upward movement changed from the state of FIG. 4*b* to the state of FIG. 4*c*, so that the second holder 400 is stopped and only the first holder 300 and the cosmetic material 20 move upward.

Hereinafter, an explanation of the above-mentioned movements will be given in detail with reference to FIGS. 5 and 6.

Figure 5:
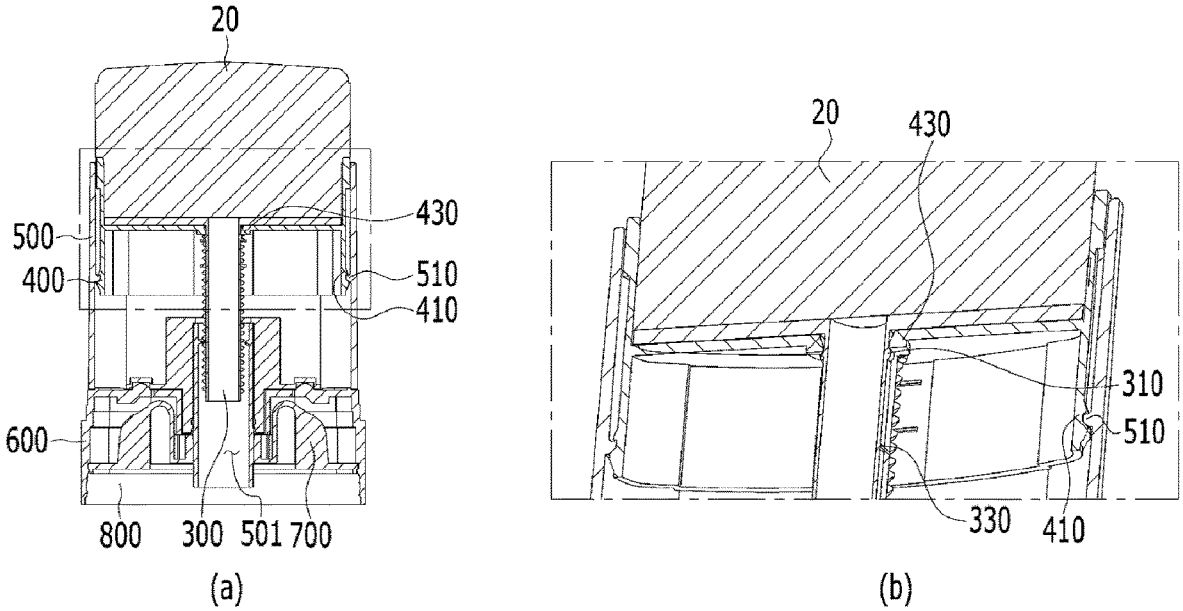
FIG. 5 is a sectional view showing an operating principle of a primary upward movement according to the present invention.
Figure 6:
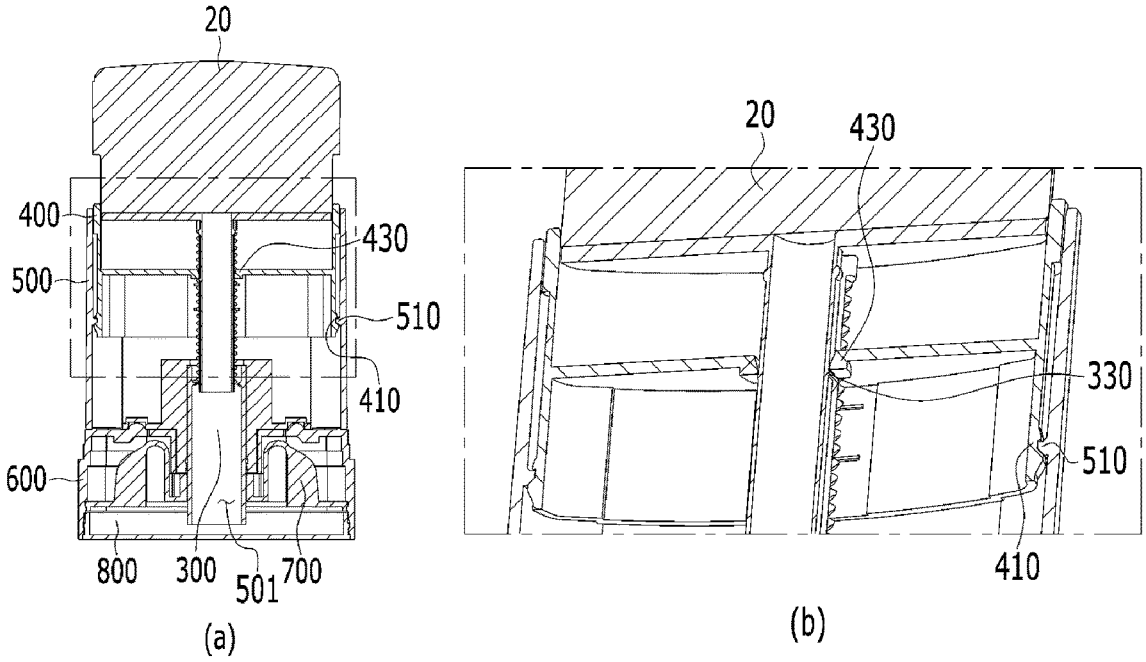
FIG. 6 is a sectional view showing an operating principle of a secondary upward movement according to the present invention.

FIG. 5 is a sectional view showing an operating principle of the primary upward movement according to the present invention, and FIG. 6 is a sectional view showing an operating principle of the secondary upward movement according to the present invention.

Referring first to FIG. 5, the inner container 500 of the present invention includes a first stopper member 510 for stopping the upward movement of the second holder 400 to primarily move the cosmetic material 20 up to the first designated position during the primary upward movement.

Further, the second holder 400 of the present invention includes a first stopper groove 410 locked onto the first stopper member 510 and a locking portion 430.

Further, as shown in FIG. 5, the first holder 300 of the present invention includes a fastening release inducer 310 and a second stopper member 330.

The second holder 400 of the present invention rotates with respect to the handle (the handle frame 600, the rotation control member 700, and the lower frame 800) and gradually moves upward, and if the cosmetic material 20 and the second holder 400 reach the first designated position, the first stopper groove 410 of the second holder 400 is locked onto the first stopper member 510 of the inner container 500, so that the cosmetic material 20 and the second holder 400 stop the upward movements at the first designated position, thereby completing the primary upward movement. In this case, the first holder 300 moves upward, together with the second holder 400.

After that, if it is desired to allow the cosmetic material 20 to move up to the second designated position higher than the first designated position, the secondary upward movement is performed so that only the first holder 300 and the cosmetic material 20 located on top of the first holder 300 move upward.

As shown in FIG. 5, the locking portion 430 of the second holder 400, which is locked onto the fastening release inducer 310 of the first holder 300, is released from the locked state as the secondary upward movement is performed, so that only the first holder 300 moves more upward. Further, as shown in FIG. 6, the locking portion 430 of the second holder 400 is locked onto the second stopper member 330 of the first holder 300 located under the fastening release inducer 310.

According to the present invention, the second stopper member 330 is locked onto the locking portion 430 released from the fastening release inducer 310 and thus stops the upward movement of the first holder 300, so that the second upward movement at the second designated position is stopped.

Next, an explanation of an operating principle of a rotating movement for moving the cosmetic material 20 up to the first designated position and the second designated position will be given with reference to FIG. 7.

Figure 7:
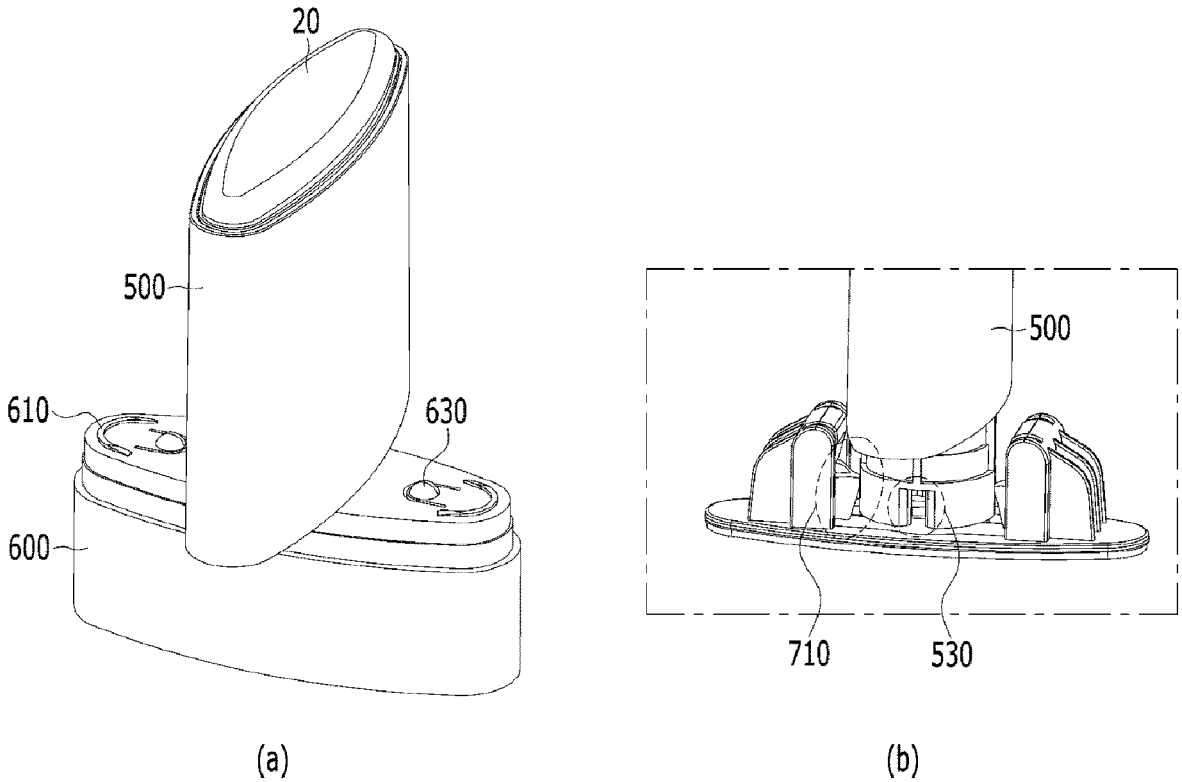
FIG. 7 is a perspective view showing an operating principle of a rotating movement according to the present invention.

FIG. 7 is a perspective view showing an operating principle of a rotating movement according to the present invention. FIG. 7*a* shows a state in which the inner container 400, the first holder 300, and the second holder 400 rotate with respect to the handle frame 600, the rotation control member 700, and the lower frame 800, and FIG. 7*b* shows a structural relation between the inner container 400 and the rotation control member 700 during the rotation.

Referring to FIG. 7*b*, the inner container 500 of the present invention has the fixing and fastening grooves 530 formed on the given portion forming the first hollow portion and thus fixedly fastened to the rotation control member 700 after rotating with respect to the rotation control member 700. According to the present invention, in specific, the cylindrical inner container 500 includes the first fixing and fastening groove 530 and the second fixing and fastening groove (not shown) formed on both sides of the lower end periphery thereof.

Further, the rotation control member 700 of the present invention include the fixing and fastening protrusions 710 formed around the lower end periphery of the given portion of the inner container 500 located at the first hollow portion and thus locally inserted into the fixing and fastening grooves 530 of the inner container 500, so that the rotation control member 700 is fastened to the inner container 500. In the same manner as above, the fixing and fastening protrusions 710 include the first and second fixing and fastening protrusions.

The first fixing and fastening protrusion 710 at a reference position (reference state) of the stick type cosmetic container 10 as shown in FIGS. 1 and 3 is fixedly inserted into the first fixing and fastening groove 530.

If the stick type cosmetic container 10 rotates, further, the first fixing and fastening protrusion 710 fixedly inserted into the first fixing and fastening groove 530 escapes from the first fixing and fastening groove 530 along the slant portion of the first fixing and fastening groove 530, so that the rotating movement is performed. According to the present invention, the first and second fixing and fastening protrusions are elastic members with elastic forces, and upon the rotating movement, accordingly, they escape from the first and second fixing and fastening grooves through the elastic forces generated therefrom.

According to another embodiment of the present invention, in the viewpoint of the inner container 500, if the inner container 500 rotates with respect to the rotation control member 700, the first fixing and fastening groove 530 of the inner container 500 inserted into the first fixing and fastening protrusion 710 escapes from the first fixing and fastening protrusion 710, so that the inner container 500 rotates. The first fixing and fastening groove 530 escaping from the first fixing and fastening protrusion 710 is insertedly coupled to the second fixing and fastening protrusion (not shown) formed on the opposite side to the first fixing and fastening protrusion 710 after rotates once, and accordingly, the inner container 500 is fixedly fastened to the handle (the handle frame 600, the rotation control member 700, and the lower frame 800).

The second fixing and fastening groove and the second fixing and fastening protrusion have the same operation as the first fixing and fastening groove and the first fixing and fastening protrusion as mentioned above, and a specific explanation of them will be omitted.

Referring to FIG. 7*a*, the handle frame 600 includes guide members 610 and sensitivity control members 630 disposed on top thereof and thus coming into contact with the underside of the inner container 500.

According to the present invention, the guide members 610 serve to guide the inner container 500 so that the inner container 500 is located back to the reference position (reference state) after rotates once in the process of the secondary upward movement.

Further, the sensitivity control members 630 are formed on one side of the guide members 610 to relieve the sensitivity generated upon the rotating movement in the process of the secondary upward movement.

In this case, the fixing and fastening grooves 530 and the fixing and fastening protrusions 710 serve to allow the inner container 500 to be located at the reference position in the process of the primary upward movement, and the guide members 610 serve to allow the inner container 500 to be located at the reference position in the process of the secondary upward movement.

Figure 8:
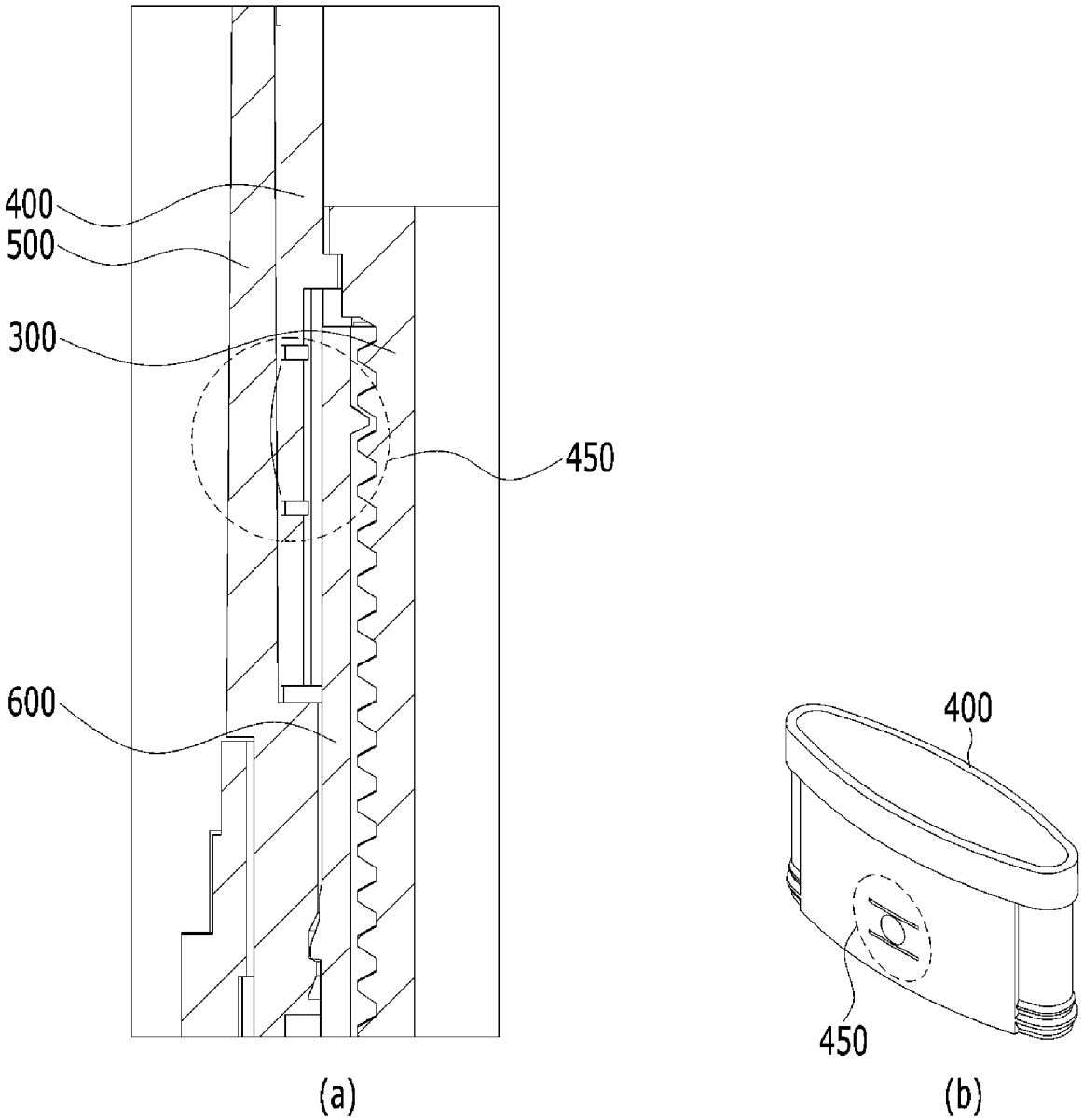
FIG. 8 is a schematic view showing the second holder according to the present invention.

FIG. 8 is a schematic view showing the second holder according to the present invention.

Referring to FIG. 8, the second holder 400 has a sensitivity relieving member 450 formed on one surface thereof to relieve the sensitivity generated from the upward or downward movement thereof with respect to the inner container 500. According to the present invention, the sensitivity relieving member 450 is convexly formed outward therefrom toward the inner container 500.

As mentioned above, the stick type cosmetic container 10 according to the present invention allows the cosmetic material to be used up, without remnant left therein and is separately thrown away after the completion of the use. Further, the stick type cosmetic container 10 according to the present invention is simple and convenient in configuration, thereby improving productivity and usability thereof.

The foregoing description of the embodiments of the invention has been presented for the purpose of illustration; it is not intended to be exhaustive or to limit the invention to the precise forms disclosed. Persons skilled in the relevant art can appreciate that many modifications and variations are possible in light of the above teachings. It is therefore intended that the scope of the invention be limited not by this detailed description, but rather by the claims appended hereto. For example, the parts expressed in a singular form may be dispersedly provided, and in the same manner as above, the parts dispersed may be combined with each other.

Thus, although the invention has been described with respect to specific embodiments, it will be appreciated that the invention is intended to cover all modifications and equivalents within the scope of the following claims.

The invention claimed is:

1. A stick type cosmetic container comprising:

a first holder for supporting the underside of a cosmetic material to allow the cosmetic material to move in upward and downward directions;

a handle for controlling the upward and downward movements of the cosmetic material and having a first hollow portion formed at the inside thereof;

an inner container located at the first hollow portion and thus rotatable with respect to the handle and having fixing and fastening grooves formed on the lower end periphery thereof and thus fixedly fastened to the handle whenever the inner container rotates once; and a second holder located inside the inner container to support the underside of the first holder, wherein the handle comprises:

a rotation control member having fixing and fastening protrusions locally inserted into the fixing and fastening grooves of the inner container;

a lower frame located under the rotation control member and thus provided as the underside of the stick type cosmetic container; and a handle frame for covering the rotation control member and the side periphery of the lower frame, wherein the fixing and fastening grooves comprise a first fixing and fastening groove and a second fixing and fastening groove and the fixing and fastening protrusions comprise a first fixing and fastening protrusion and a second fixing and fastening protrusion, so that when the inner container rotates with respect to the rotation control member, the first fixing and fastening groove escapes from the first fixing and fastening protrusion, rotates once, and is thus coupled to the second fixing and fastening protrusion to allow the handle and the inner container to be fixedly fastened to each other again, wherein the handle frame comprises:

guide members disposed on top thereof and coming into contact with the underside of the inner container to guide the inner container so that the inner container is located back to a reference position after once rotation in the process of a secondary upward movement; and sensitivity control members disposed on one side of the guide members to relieve the sensitivity generated upon the rotating movement in the process of the secondary upward movement.

2. The stick type cosmetic container according to claim 1, wherein the fixing and fastening grooves and the fixing and fastening protrusions serve to allow the inner container to be located at the reference position in the process of a primary upward movement, and the guide members serve to allow the inner container to be located at the reference position in the process of the secondary upward movement.

3. The stick type cosmetic container according to claim 1, wherein the inner container comprises a first stopper member for stopping the upward movement of the second holder to move the cosmetic material up to a first designated position during the primary upward movement, and the second holder comprises a locking portion and a first stopper groove locked onto the first stopper member.

4. The stick type cosmetic container according to claim 3, wherein the first holder comprises:

a fastening release inducer for inducing the fastening release of the locking portion to allow the second holder to secondarily move the cosmetic material upward after the primary upward movement; and a second stopper member locked onto the locking portion released from the fastening to allow the secondary upward movement of the second holder to be stopped at a second designated position.

5. The stick type cosmetic container according to claim 1, wherein the second holder comprises a sensitivity relieving member formed on one surface thereof to relieve the sensitivity generated from the upward or downward movement thereof with respect to the inner container.

6. The stick type cosmetic container according to claim 1, further comprising an outer container for surroundingly covering the inner container.

* * * * *